United States Patent [19]

Lack et al.

[11] 4,158,943

[45] Jun. 26, 1979

[54] METHOD AND APPARATUS FOR PLACING A VALVE BAG ON A FILLING SPOUT

[75] Inventors: Donald C. Lack, Stockton-on-Tees, England; Charles R. Murray, Brampton, Canada

[73] Assignee: Canadian Industries Limited, Montreal, Canada

[21] Appl. No.: 914,058

[22] Filed: Jun. 9, 1978

[30] Foreign Application Priority Data

Jun. 23, 1977 [CA] Canada ..... 281299

[51] Int. Cl.[2] ..... B65B 43/36

[52] U.S. Cl. ..... 53/459; 53/506; 53/571; 53/385

[58] Field of Search ..... 53/459, 506, 571, 385

[56] References Cited

U.S. PATENT DOCUMENTS 3,287,879 11/1966 Miller ..... 53/571

3,785,414 1/1974 Obara ..... 53/571 X

*Primary Examiner*—Travis S. McGehee

*Attorney, Agent, or Firm*—Guy Drouin

[57] ABSTRACT

Flexible plastic valve bags having a valve opening spaced from an edge of the bag are placed on filling spouts by first advancing the bag towards a filling spout on a carriage, and means are provided for blocking the communication of the valve opening with the body of the bag and means are provided for blowing open and billowing the valve opening of the bag while it is being moved towards the spout, and the blown-open valve is in direct alignment with the spout. Another embodiment provides for the location and placing of bags on at least two spouts by mounting the carriage on a lateral traveller such that when one bag is placed on a first spout, the traveller and carriage will be activated to move into alignment with a second spout.

15 Claims, 8 Drawing Figures

METHOD AND APPARATUS FOR PLACING A VALVE BAG ON A FILLING SPOUT

BACKGROUND OF THE INVENTION

1. Field of the Invention

The present invention is related to a method and apparatus for filling containers, and more particularly, for filling valved flexible bags.

2. Description of the Prior Art

Flexible plastic valve bags are generally used for packaging powdered materials such as fertilizers, Portland cement, etc. Such valve bags are described in Canadian Pat. No. 984,346, issued Feb. 24, 1976, Charles R. Murray, inventor. In this patent, the valve bag is described as having a back wall and a front wall made of two panels partially overlapping each other with the two panels, in their common area of overlap, being sealed together along a line substantially parallel to and at a distance from the top end of the bag and thus forming a tubular self-closing opening extending transversely of the bag adjacent the top end thereof. The panels in their common area of overlap area also united together along at least one line extending from the tubular opening to the bottom of the bag. The tubular opening is of such diameter and is so located transversely of the bag as to allow insertion therein of a filling spout and free delivery of filling material from the spout.

Heretofore no suitable bag handling apparatuses have been available which could automatically place such valve bags onto a spout and hold them there while they were being filled. Certain apparatuses have been developed which include a pick-up arm having suction cups adapted to pick up a bag and place it on the spout. However, the suction cups require a clean environment which is not available in fertilizer or cement filling environments, for instance.

SUMMARY OF THE INVENTION

It is an aim of the present invention to provide a fully automated method and apparatus for placing a valve bag of the type described in Canadian Pat. No. 984,346 onto a spout, retaining the bag on the spout while the spout is being filled, and removing the bag from the spout.

A construction in accordance with the present invention includes means for advancing a valve bag towards a tubular filling spout when the valve bag includes a tubular opening spaced from one edge of the bag, means for advancing the bag towards the filling spout, means for holding the edge of the bag while blowing air into the tubular opening to billow the opening of the bag, means for blocking communication between the tubular opening of the bag and the body of the bag so as to prevent billowing of the body of the bag, and means for retaining the bag on the filling spout once the billowed tubular opening of the bag has been engaged on the spout.

A more specific construction in accordance with the present invention includes an apparatus adapted to operate with a tubular spout, the apparatus comprising a frame, track means supported on the frame, a carriage mounted for movement on the track means to and from the filling spout, magazine means on the carriage for supporting valve bags to be filled, each valve bag including an edge, a tubular self-closing opening extending from, but spaced from, the edge, the tubular opening communicating with the interior of the bag, gate means on said carriage for blocking the communication between said tubular self-closing opening and the interior of the bag, an air jet means associated with the carriage and adapted to supply air under pressure to expand and open the self-closing tubular opening when the carriage is moving towards the spout to enable placing of the bag on the spout, means for moving the carriage towards said spout, means for aligning the opening onto the spout, means for retaining the bag on the spout, and means for retracting the carriage from the area of the spout.

A method in accordance with the present invention includes advancing a valve bag towards a filling station including a tubular spout, wherein the bag has a tubular opening spaced from an edge thereof, advancing the bag towards a tubular filling spout, engaging an edge of the bag while simultaneously blowing air into the tubular opening to billow the bag and blocking the communication between the tubular opening of the bag and the body of the bag to prevent billowing of the bag while it is moving towards the filling spout, and retaining the bag on the filling spout.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
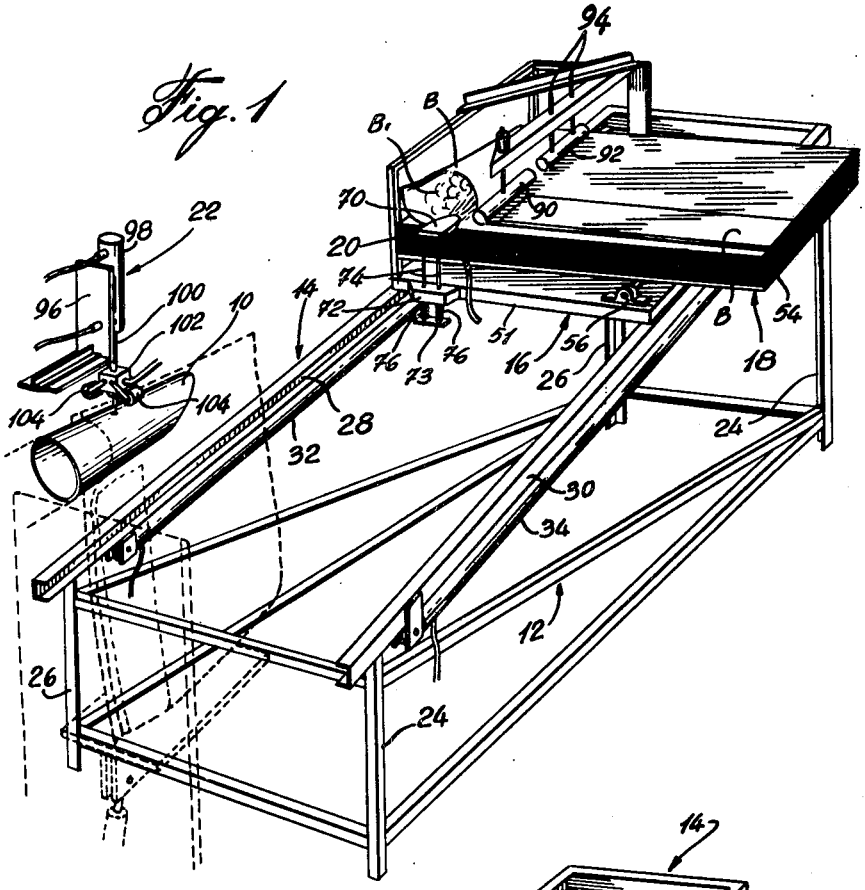
FIG. 1 is a perspective view of a first embodiment of the present invention shown in a first operative position.
Figure 2:
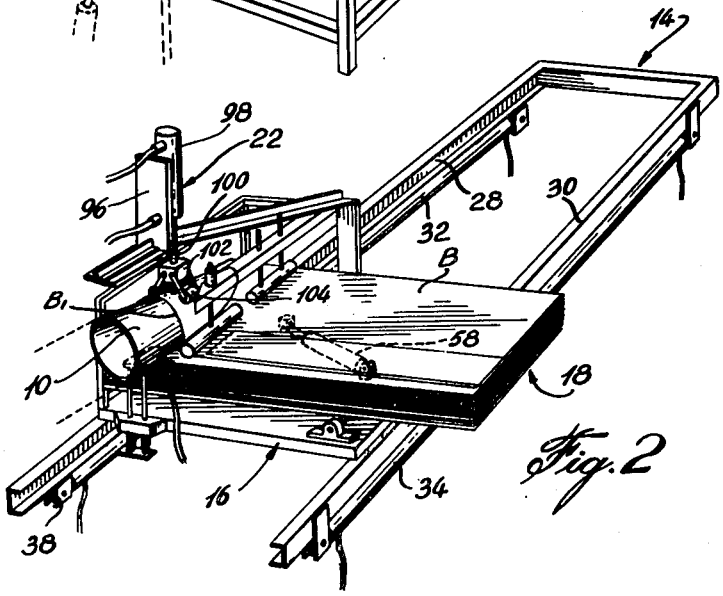
FIG. 2 is a perspective view similar to FIG. 1 showing the apparatus in a succeeding operative position.

Referring now to the drawings, and especially to FIGS. 1 through 5, there is shown the representation of a spout 10 of a typical filling machine (not shown). The spout 10 has the shape of a tapered tube with an angled opening at the front end thereof. The bag handling apparatus can include a frame 12 which can be either fixed in front of the filling machine or be adapted to be moved from one location to another. A track 14 is mounted on the frame 12 on which a carriage 16 is adapted to reciprocate to and from the spout 10. The carriage 16 mounts a magazine 18 for carrying a stack of bags B with a clamp 20 having an air jet nozzle.

The frame includes upstanding columns 24 and 26 on which are supported a pair of opposed parallel rails 28 and 30 forming the track 14.

Figure 5:
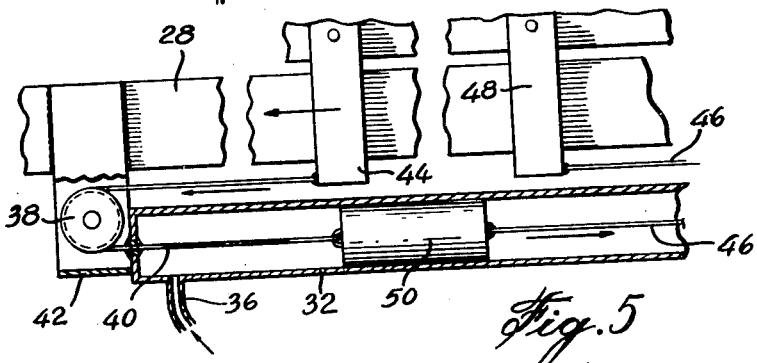
FIG. 5 is an enlarged fragmentary elevation, partly in cross-section, of a detail of the apparatus in FIGS. 1 to 4.

Each rail 28 and 30 is formed from a channel member of appropriate size. An elongated air cylinder 32 is affixed to rail 28 while a similar air cylinder 34 is affixed to the rail 30. At each end of the air cylinder, there is provided a pulley 38, 39. As shown in FIG. 5 in cross-section, the air cylinder 32 is shown in which a piston 50 travels. A cord 40 is attached to the piston and passes over pulley 38 to be fixed to an upright 44 on the carriage 16. Likewise, a cord 46 is attached to the piston 50 and passes over the pulley 39 and is finally attached to an upstanding member 48 on the carriage 16.

Figure 3:
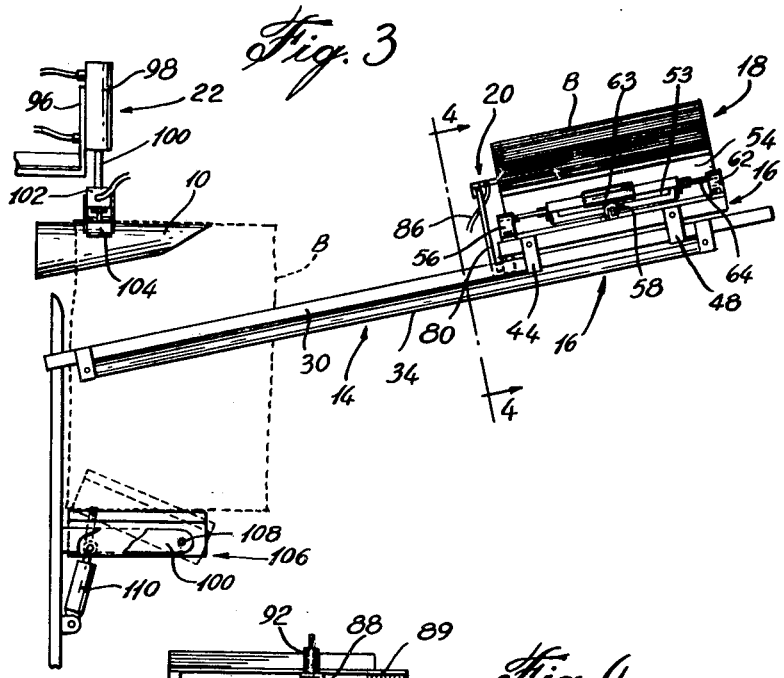
FIG. 3 is a side elevation of an apparatus which is another embodiment of the invention shown in FIG. 1.
Figure 4:
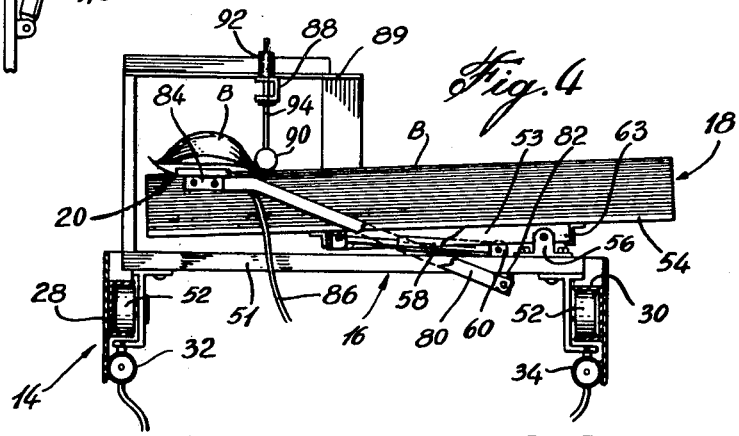
FIG. 4 is a vertical cross-section taken along line 4—4 of FIG. 3.

The carriage 16 includes a platform 51 mounting wheels 52 which are adapted to travel in the rails 28 and 30 of the track 14, as shown in FIG. 4. Brackets 56 and 62 are fixed to the platform 51, and a sub-frame 53 is pivotally mounted thereto. A piston and cylinder arrangement 58 is pivotally mounted to a bracket 60 on the platform 51 at one end and to the sub-frame 53 at the other end thereof. A loading tray 54 is removably mounted on the sub-frame 53. A bracket 63 made up of angle irons is fixed to the loading tray 54 and fits on the sub-frame 53 when in place. The sub-frame 53, as shown in FIG. 3, is fixed to a shaft 64 which in turn is journaled in the pivot brackets 56 and 62. The loading tray 54 is supplied with stacks of plastic bags B to be filled.

As previously mentioned, the bags B are formed such that a valve opening $B_1$ as provided near one end thereof is spaced from the longitudinal edge of the bag. The valve opening includes a flattened tubular opening formed by heat seams in the plastic bag. The opening communicates with the main body of the bag laterally of the longitudinal axis of the bag. The bags B are laid on the platform 54 such that the opening spaced from the edge of the bag is adjacent the clamp 20.

FIG. 1 shows one embodiment of the clamp and air nozzle 20 whereby a clamp head 70 is provided which is flattened in shape and has an elongated air jet nozzle at the front end thereof. The nozzle head 20 is mounted on a pair of rods 74 adapted to slide in the bracket 72 mounted to the platform 51 of the carriage 16. A plate 73 is provided at the bottom of the rods 74, and springs 76 are mounted between the plate 73 and the bracket 72. The springs urge the clamp 70 downwardly to hold the bags B onto the leading tray 54.

In another embodiment of the clamp and air nozzle combination 20 as shown in FIGS. 3 and 4, there is an elongated arm 80 pivoted to a pivot bracket 82 on the plaform 51. The arm 80 mounts a flattened clamp-nozzle head 84. An air hose 86 feeds air to the head 84. The leverage weight of the head 84 on the end of the arm 80 provides the necessary pressure of the clamp-nozzle head 84 on the bag B.

As shown in the embodiment of FIGS. 1 through 5, there is a gate holder member 88 mounted to a frame 89 fixed to the platform 51 of the carriage 16. The gate holder member 88 mounts a pair of gate members 90 and 92. Gate 90 is adjustably fixed to the gate holder 88, as shown in FIGS. 1 and 4. Gate 90 acts as an abutment to provide the proper level of the bag B to be filled. A sliding gate 92 is mounted to the gate holder 88 and has a pair of rods 94. Gate 92 rests on the top of the bag, adjacent gate 90, by its own weight.

Mounted on the filling machine by means of a bracket 96, there is a bag holder 22 adapted to hold and retain onto spout 10 the bags individually and successively fed thereto. The bag holder 22 includes a cylinder 98 and a piston rod 100 at the end of which are mounted a switch 102 and bag holding rubber rollers 104.

Finally, a tilting chair 106 is mounted to the bag filling machine which includes a pivot stub shaft 108 nad a piston and cylinder arrangement 110 to tilt the bag from the spout 10.

In operation, the embodiments shown in FIGS. 1 to 5 operate in essentially the same manner. The magazine 18 which includes a loading tray 54 is supplied with a stack of bags B. The magazine 18 is then placed on the carriage such that the bracket 63 underneath the tray 54 engages the subframe 53 pivoted to the platform 51 of the carriage. The gate 90 has been adjusted such that when the bags abut against the gate 90, they are at the proper height to be engaged onto the spout 10. The piston and cylinder arrangement 58 can be activated such that the loading tray 54 is pivoted upwardly until the upper bag B abuts against the gate 90. The combined clamp and air nozzle 20, be it in the form of the head 70 or 84, is dropped onto the edge of the bags B in a direction towards the open valve of the bag B which is in a flattened condition. Air pressure is then directed through the air nozzles 70 or 84, forcing the valve opening to billow as shown in FIGS. 1 and 4.

The gate 92, which rests on the bag, blocks the valve opening from the body of the bags so that the air entering and billowing the valve opening will not pass into the body of the Bag B unnecessarily billowing the body of the bag B.

Figure 7:
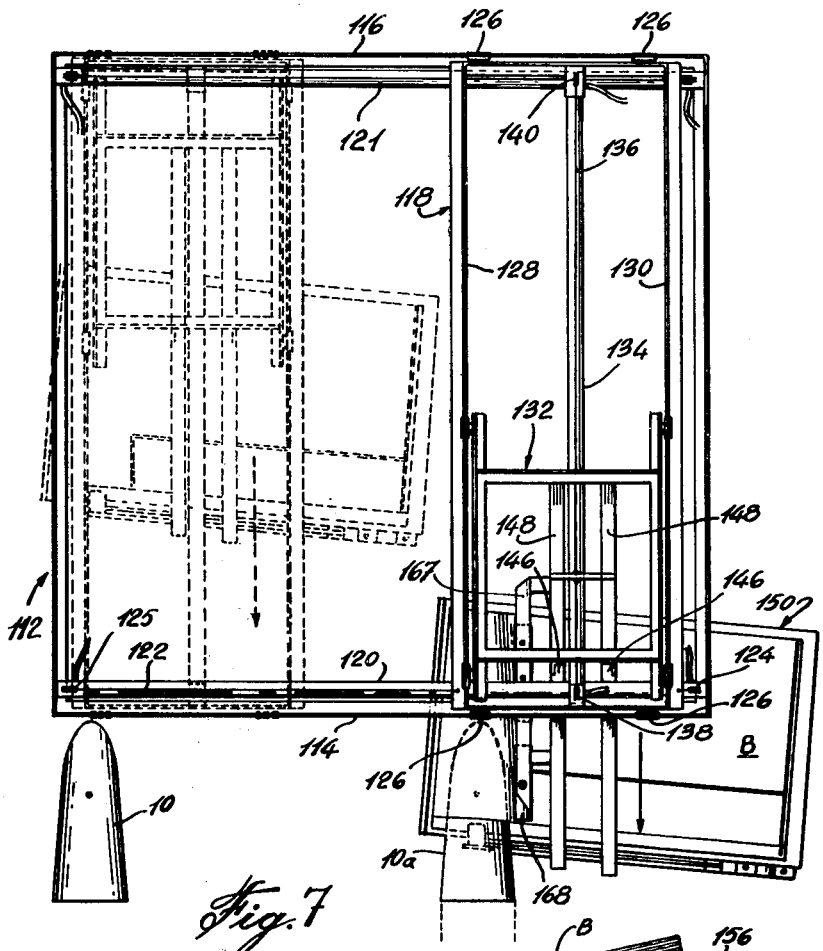
FIG. 7 is a top plan view of the apparatus shown in FIG. 6 but located in a different operative position.

While there operations are going on, the carriage 16 is moving towards the spout 10. The track 14 is normally laid at an angle such that the plane of the top bag on the magazine is in line and parallel to the bottom surface of the tapered spout 10. Likewise, the magazine and carriage is at a slight angle in plan view, as shown in FIG. 7, such that the top edge of the bag to be filled is parallel and in line eventually with the side surface of the tapered spout 10. As the carriage 16 approaches the filling machine, the immovable spout 10 will be forced to enter the opened billowed aligned portion of the valve of the bag B. When the carriage 16 has arrived at the end of its travel, the bag holder 22 will be activated such that the piston rod 100 will move downwardly, and the rollers 104 will engage the bag B. At the same time, a projection from the switch 102 will abut against the bag film. If no bag B is fed onto the spout 10 either accidentally or through a lack of bags on the magazine 18, the projection then passes through an opening provided in the spout 10 rather than be stopped by the bag which would normally cover the opening, and thus the switch 102 would prevent the feeding control from feeding the powder through the spout 10.

The carriage 16 is then immediately activated to return to its initial position as shown in FIG. 1, and a constant pressure in the cylinder 58 causes the tray 54 to move slightly upwardly such that the next bag B engages the gate 90. As the carriage 16 is withdrawn, the bag B, of course, remains held on the spout 10. When the bag B is filled, the chair 106 is activated by the cylinder and piston 110 to tip the bag B from the spout 10. The bag holder 22 is also reactivated to its initial position. The chair 106 could be weight sensitive or be arranged such that as the bag B fills, it automatically tilts and activates various sequential switches to retract the bag holder 22 to cause the carriage 16 to start another cycle.

Figure 6:
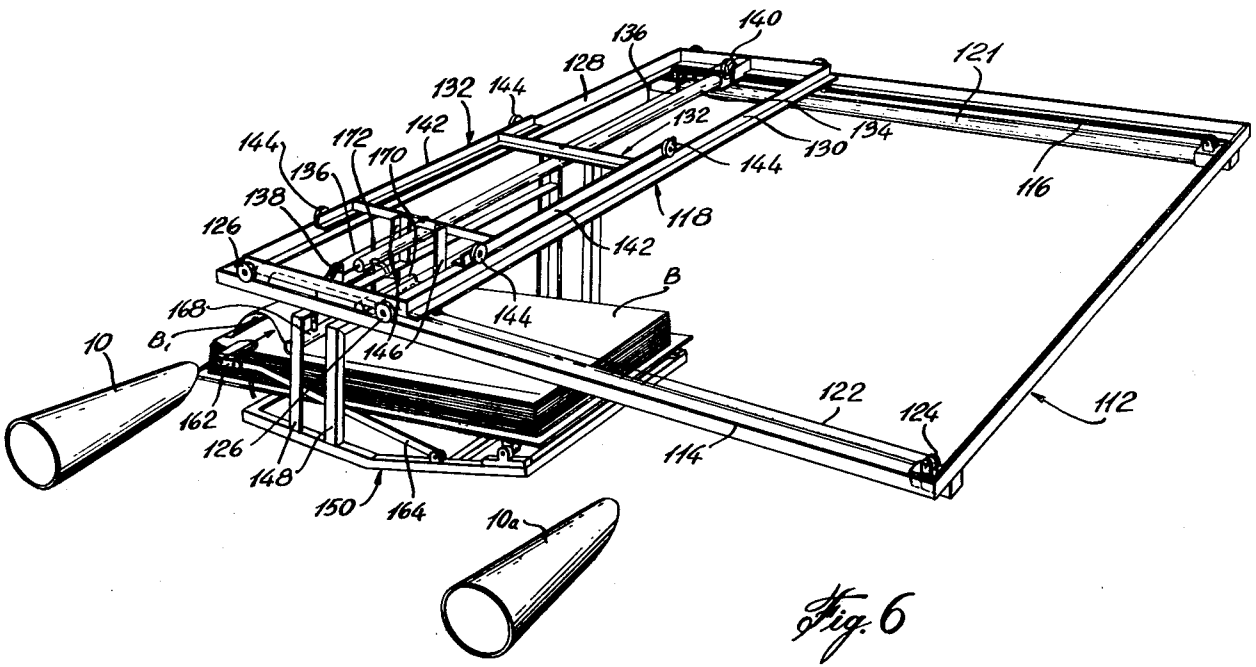
FIG. 6 is a perspective view of a third embodiment of the present invention.
Figure 8:
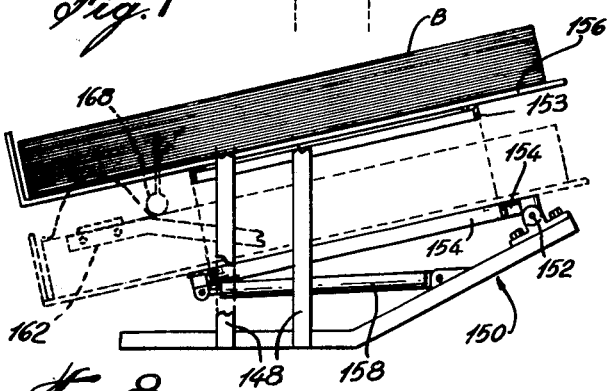
FIG. 8 is an elevational fragmentary view of a detail of the apparatus shown in FIGS. 6 and 7.

Referring now to the embodiments shown in FIGS. 6, 7 and 8, there is provided a pair of spouts 10 and 10*a*. A frame 112 is located in front of the filling machine facing the spouts 10 and 10*a*. The frame 112 mounts a pair of opposed parallel rails 114 and 116 forming a track for the traveller 118. The traveller 118 moves laterally of the spouts 10 and 10*a* on the rails 114 and 116. The movement of the traveller 118 is controlled and provided by a pair of elongated air cylinders 120 and 121 with cords 122 passing over pulleys 124 and 125 similar to those described previously. The traveller 118 includes wheels 126 at each corner thereof which travel on the rails 114 and 116. The traveller 118 also includes rails 128 and 130 which extend in the longitudinal direction of the traveller and is at right angles to the rails 114 and 116. A carriage 132 moves on the rails 128 and 130 of the traveller 118 in a direction at right angles to the direction of movement of the traveller 118. Similarly, an air cylinder 134 extends longitudinally and is fixed to the traveller 118. A cord 136 passing over pulleys 138 and 140 is connected to the carriage 132 for movement thereof. The carriage has a frame 142 with upstanding members 146 hanging from the frame 142 and connected to a magazine frame 148. The magazine frame 148 mounts a magazine support 150 underneath the frame 142.

The magazine support 150 includes a pivot shaft 152 to which a sub-frame 154 is pivoted, and the pivoting movement is controlled by a piston and cylinder arrangement 158. A removable loading tray 156 has a bracket 153 which sits on the sub-frame 154 as shown in FIG. 8.

A gate holder 167 is provided on the frame 148 and mounts an adjustable gate member 168 which, as described in the embodiments of FIGS. 1 to 5, controls the height or level of the bags B. A sliding gate 174 is also provided, which rests on the bags B, to cut off the communication from the valve opening of the bag B to the body of the bag as in the previous embodiment.

In operation, the apparatus shown in FIGS. 6 through 8 can be used with a double-headed filler or with a pair of adjacent fillers each having projecting spouts 10 and 10*a*. It is obvious that the apparatus described in FIGS. 6 through 8 could be adapted for more than two filling spouts.

In operation, a stack of bags 8 is placed on the loading tray 156 which is then placed on the magazine support 150 with the bracket 153 properly engaged in the subframe 154. Air pressure is then fed to the piston and cylinder arrangement 158 such that a constant pressure is provided, forcing the subframe 154 to pivot clockwise such that the top bag B is always abutting against the gate 168.

Simultaneously, the air cylinder 134 is activated so that the carriage 132 mounting the magazine support 150 will move towards the spout 10. At the same time, air pressure is directed to the clamp and air nozzle head 162 which is placed on the edge of the top bag B in order to open the valve of the top bag B as shown in FIG. 6. The weight of the clamp head 162 on the end of the lever arm 164 will, of course, provide the proper clamping pressure on the edge of the bag adjacent the valve opening. As the carriage advances towards the spout 10, the open valve of the top bag B will engage on the spout 10, and a bag clamping device (not shown) similar to that illustrated in FIGS. 1 to 5 at 22 will engage the film of the bag on the spout 10. The air cylinder 134 will then be activated to retract the carriage 132, thereby leaving the top bag B on the spout 10.

The air cylinder 120 and a companion air cylinder 121 will then move the traveller 118 towards the right in the drawings, aligning the carriage 132 with the spout 10*a*. Once the traveller 118 is aligned therewith and the carriage 132 is completely retracted, the cycle of the carriage 132 will be reinitiated such that the cylinder 134 and the cord 136 will cause the carriage 132 to move towards the spout 10*a*, and at the same time, the clamp and air nozzle 162 will blow open the valve of the top bag B so that it will engage on the spout 10*a*. Once the carriage will have completed the new cycle, the traveller 118 will be retracted back to its initial position in alignment with the spout 10, by means of the air cylinders 120 and 121.

I claim:

1. An apparatus for placing a valve bag on a tubular filling spout, wherein the bag includes a tubular opening spaced from an edge of the bag, the apparatus including means for advancing the bag towards the filling spout, means for holding down the edge of the bag while simultaneously blowing air into the tubular opening to billow the tubular opening of the bag, means for blocking communication between the tubular opening of the bag and the body of the bag to prevent billowing of the body of the bag, and means for holding and retaining the bag on the spout once the bag has engaged the spout.

2. An apparatus for placing a valve bag on a tubular filling spout, the apparatus including track means adapted to be aligned with the spout, a carriage mounted for movement on the track means to and from the filling spout, magazine means on the carriage for supporting valve bags to be filled, with each valve bag including an edge, a tubular self-closing opening extending from and spaced from the edge, the tubular opening communicating with the interior of the bag, gate means on said carriage for blocking the communication between said tubular opening and the interior of the bag, an air jet means associated with the carriage and adapted to supply air under pressure to expand and open the self-closing tubular opening when the carriage is moving towards the spout to enable placing of the bag on the spout, means for moving the carriage towards said spout, means for aligning the opening onto the spout, means for retaining the bag on the spout, and means for retracting the carriage from the area of the spout.

3. An apparatus as defined in claim 2, wherein the track means includes a pair of rails located on a frame, the rails extending parallel to a vertical plane through a longitudinal axis of the spout, and the rails being parallel to the bottom surface of the spout.

4. An apparatus as defined in claim 3, wherein the carriage includes means adapted to roll on the rails in a direction to and from the filling spout, and the carriage mounts the magazine, abutment means provided on the carriage above the magazine, means for raising the magazine to abut the top bag against the abutment means such that the top bag is aligned with the bottom surface of the filler spout.

5. An apparatus as defined in claim 4, wherein the air jet means is in the form of a flat clamping head adapted to resiliently engage the edge of the top bag to hold the edge down and the air nozzle being directed towards the tubular opening of the valve bag such that when air is passed under pressure through the air nozzle, the tubular opening will billow and will be in line with the filler spout such that it will surround the filler spout when the carriage has approached the filler spout.

6. An apparatus as defined in claim 5, wherein the clamping air nozzle head is mounted on a pair of parallel rods passing through a bracket mounted to the carriage, and resilient spring means urge the clamp head and the rods downwardly through the bracket.

7. An apparatus as defined in claim 5, wherein the clamping head air nozzle means includes a flat head adapted to engage the edges of the top bag mounted to an elongated pivoting lever pivotally mounted to the carriage such that the weight of the lever and the head firmly engage the top edge of the bag.

8. An apparatus as defined in claim 2, wherein the means for retaining the bag on the spout includes reciprocating bag retaining members and a switch means operative to stop the filling function of the spout when a bag is not fed on the spout.

9. An apparatus as defined in claim 4, wherein the magazine includes a removable platform adapted to be placed on a locating frame pivotally mounted to the carriage, and means resiliently urge the locating frame and the magazine platform upwardly about the pivot point such that the bags on the magazine are continuously urged against the abutting means.

10. An apparatus as defined in claim 2, wherein the track means is mounted on a lateral traveller which in turn is mounted for movement on a frame allowing the traveller to move in a direction lateral of the filling spout such that more than one spout can be filled successively, and means are provided for moving the traveller and therefore the track means and carriage from a position aligned with a first spout means to a second position aligned with a second spout means.

11. An apparatus as defined in claim 3, wherein the magazine is mounted such that the edge of the magazine is parallel to the side surfaces of the spout.

12. An apparatus as defined in claim 1, wherein the means for holding down the edge of the bag and for blowing air into the tubular opening of the bag is in the form of a flat clamping head adapted to resiliently engage the edge of the top bag to hold the edge down and the air nozzle being directed towards the tubular opening of the valve bag such that when air is passed under pressure through the air nozzle, the tubular opening will billow and will be in line with the filler spout such that it will surround the filler spout when the carriage has approached the filler spout.

13. An apparatus as defined in claim 12, wherein the clamping air nozzle head is mounted on a pair of parallel rods passing through a bracket mounted to the carriage, and resilient spring means urge the clamp head and the rods downwardly through the bracket.

14. An apparatus as defined in claim 13, wherein the clamping head air nozzle means includes a flat head adapted to engage the edges of the top bag mounted to an elongated pivoting lever pivotally mounted to the carriage such that the weight of the lever and the head firmly engage the top edge of the bag.

15. A method for filling valve bags when the bags include a tubular opening adapted to engage a tubular filling spout, including advancing the bags in a flattened condition towards the spout, clamping the edge of the bag while simultaneously blowing air under pressure into the opening in order to billow the tubular opening of the bag while at the same time blocking communication of the tubular opening to the body of the bag so that the remainder of the bag remains in a flattened condition, thereby allowing the tubular opening of the bag to surround the spout when the bag is advanced into the spout.

* * * * *